US011088460B2

(12) United States Patent
Sanjuan Flores et al.

(10) Patent No.: US 11,088,460 B2
(45) Date of Patent: Aug. 10, 2021

(54) REFLECTOR ANTENNA ARRANGEMENT

(71) Applicant: Nokia Solutions and Networks Oy, Espoo (FI)

(72) Inventors: Tomas Sanjuan Flores, Madrid (ES); Alfonso Fernandez Duran, Madrid (ES)

(73) Assignee: Nokia Solutions and Networks Oy, Espoo (FI)

( * ) Notice: Subject to any disclaimer, the term of this patent is extended or adjusted under 35 U.S.C. 154(b) by 0 days.

(21) Appl. No.: 16/295,401

(22) Filed: Mar. 7, 2019

(65) Prior Publication Data

US 2019/0280391 A1 Sep. 12, 2019

(30) Foreign Application Priority Data

Mar. 7, 2018 (EP) ..... 18382141

(51) Int. Cl.
*H01Q 15/16* (2006.01)
*H01Q 5/307* (2015.01)
(Continued)

(52) U.S. Cl.
CPC ..... *H01Q 15/16* (2013.01); *H01Q 1/38* (2013.01); *H01Q 1/405* (2013.01); *H01Q 1/42* (2013.01);
(Continued)

(58) Field of Classification Search
CPC .... H01Q 15/16; H01Q 15/142; H01Q 3/2658; H01Q 3/2664; H01Q 3/18; H01Q 3/08;
(Continued)

(56) References Cited

U.S. PATENT DOCUMENTS 4,581,615 A 4/1986 Levy
5,673,057 A * 9/1997 Toland ..... H01Q 19/191 343/761
(Continued)

FOREIGN PATENT DOCUMENTS

CN 1254447 A 5/2000
CN 2744001 Y 11/2005
(Continued)

OTHER PUBLICATIONS

Emami et al., "A 60GHz CMOS Phased-Array Transceiver Pair for Multi-Gb/s Wireless Communications", IEEE International Solid-State Circuits Conference, Feb. 20-24, 2011, pp. 164-166.
(Continued)

*Primary Examiner* — Seokjin Kim
(74) *Attorney, Agent, or Firm* — Harrington & Smith

(57) ABSTRACT

According to an aspect, there is provided an antenna arrangement. Said antenna arrangement comprises two or more feed antennas adapted to transmit and receive radio signals. The two or more feed antennas comprise at least a first feed antenna adapted to operate in a first frequency band and a second feed antenna adapted to operate in a second frequency band, where the first and second frequency bands being discontiguous with each other. Moreover, the antenna arrangement comprises an antenna radome arranged around the two or more feed antennas. Said antenna radome comprises a metallic section implementing an antenna reflector for the two or more feed antennas and a nonmetallic section penetrable by radio waves.

13 Claims, 9 Drawing Sheets

(51) Int. Cl.

| | |
|---|---|
| ***H01Q 1/38*** | (2006.01) |
| ***H01Q 1/42*** | (2006.01) |
| ***H01Q 3/08*** | (2006.01) |
| ***H01Q 21/28*** | (2006.01) |
| ***H01Q 25/00*** | (2006.01) |
| ***H01Q 3/18*** | (2006.01) |
| ***H01Q 1/40*** | (2006.01) |
| ***H01Q 3/26*** | (2006.01) |
| ***H01Q 19/17*** | (2006.01) |
| ***H01Q 15/14*** | (2006.01) |

(52) U.S. Cl.
CPC ..... *H01Q 3/08* (2013.01); *H01Q 3/18* (2013.01); *H01Q 3/2658* (2013.01); *H01Q 3/2664* (2013.01); *H01Q 5/307* (2015.01); *H01Q 15/142* (2013.01); *H01Q 19/17* (2013.01); *H01Q 21/28* (2013.01); *H01Q 25/007* (2013.01)

(58) Field of Classification Search
CPC ..... H01Q 19/17; H01Q 1/405; H01Q 25/007; H01Q 21/28; H01Q 1/42; H01Q 1/38; H01Q 5/307; H01Q 1/12; H01Q 21/24; H01Q 21/30
See application file for complete search history.

(56) References Cited

U.S. PATENT DOCUMENTS

| | | | | |
|---|---|---|---|---|
| 2005/0068241 | A1 | 3/2005 | Desargant et al. | |
| 2009/0009416 | A1 | 1/2009 | Blalock | 343/758 |
| 2009/0219903 | A1 | 9/2009 | Alamouti et al. | |
| 2011/0105062 | A1 | 5/2011 | Ridgeway et al. | |
| 2012/0154239 | A1 | 6/2012 | Bar-Sade et al. | |
| 2014/0243043 | A1 | 8/2014 | Shen et al. | |
| 2016/0104942 | A1* | 4/2016 | Pera | H01Q 19/10 343/836 |
| 2017/0005415 | A1* | 1/2017 | Adada | H01Q 5/45 |
| 2018/0227775 | A1* | 8/2018 | Bisiules | H01Q 21/08 |
| 2019/0237874 | A1* | 8/2019 | Michaelis | H01Q 15/02 |
| 2019/0312337 | A1* | 10/2019 | Farzaneh | H01Q 21/205 |

FOREIGN PATENT DOCUMENTS

| | | | |
|---|---|---|---|
| CN | 101207238 | A | 6/2008 |
| CN | 105680181 | A | 6/2016 |
| CN | 105846051 | A | 8/2016 |
| EP | 1825567 | A1 | 8/2007 |
| EP | 1936737 | A1 | 6/2008 |
| JP | 2017184119 | A | 10/2017 |
| WO | WO-2007/007157 | A1 | 6/2007 |
| WO | 2017/004439 | A1 | 1/2017 |

OTHER PUBLICATIONS

Hong et al., "Study and Prototyping of Practically Large-Scale mmWave Antenna Systems for 5G Cellular Devices", IEEE Communications Magazine, vol. 52, No. 9, Sep. 2014, pp. 63-69.
Schönthier, "The 60 GHz Channel and its Modelling", Information Society Technologies, IST-2001-32686 Broadway, V1.0, May 30, 2003, pp. 1-160.
Wilson, "Propagation Losses Through Common Building Materials 2.4 GHz vs 5 GHz", Magis Network, Inc., E10589, Aug. 2002, pp. 1-28.
"Intel Readying 5G Modem for Millimeter Wave & Sub-6 Ghz Spectrum", SDxCentral, Retrieved on May 27, 2019, Webpage available at : https://www.sdxcentral.com/articles/news/intel-readying-5g modem-millimeter-wave-sub-6-ghz-spectrum/2017/01/.
"Meet Snapdragon X50—Qualcomm's first 5G Modem", Qualcomm, Retrieved on May 27, 2019, Webpage available at :https://www.qualcomm.com/news/onq/2016/10/17/meet-snapdragon-x50-qualcomms-first-5g-modem.
Hashemi et al., "Dual Sub-6 GHz—Millimeter Wave Beamforming and Communications to Achieve Low Latency and High Energy Efficiency in 5G Systems", arXiv, Jun. 8, 2017, 29 pages.
Zhai et al., "Ka-band Light-Weight High Efficiency Wideband 3-D Printed Reflector Antenna", International Journal of Antennas and Propagation, vol. 2017, pp. 1-6.
Basavarajappa et al., "Millimeter Wave Multibeam-Switching Antenna", arXiv, 14th International Symposium on Wireless Communication Systems, 2017, 6 pages.
Extended European Search Report received for corresponding European Patent Application No. 18382141.2, dated Sep. 27, 2018, 9 pages.

* cited by examiner

REFLECTOR ANTENNA ARRANGEMENT

FIELD OF THE INVENTION

Various example embodiments relate generally to antennas, and more particularly to reflector antennas.

BACKGROUND ART

The following description of background art may include insights, discoveries, understandings or disclosures, or associations together with dis-closures not known to the relevant art prior to the present invention but provided by the invention. Some such contributions of the invention may be specifically pointed out below, whereas other such contributions of the invention will be apparent from their context.

Millimeter-wave (mm-wave) communications will be a vital part of the forthcoming fifth generation (5G) wireless communication systems in enabling very high throughput. While the radio spectrum at these frequencies remains largely unused meaning that spectrum congestion is not a problem, the use of millimeter waves presents other challenges which have to be overcome before the deployment of the 5G systems. One such challenge is the increase in propagation loss with frequency. In addition to increased free-space path loss, the penetration loss, for example, through walls and windows, is also significantly increased at millimeter waves compared to radio frequencies used in the current generation communications systems. In order to compensate for high penetration loss and thus to provide high quality broadband service also at millimeter waves, any indoor antennas need to be able to provide very high gain.

SUMMARY

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

Various aspects of the invention comprise a method, an apparatus, and a computer program as defined in the independent claims. Further embodiments of the invention are disclosed in the dependent claims.

BRIEF DESCRIPTION OF THE DRAWINGS

In the following, some example embodiments will be described with reference to the accompanying drawings, in which FIG. 1 illustrate an example of a communications system to which embodiments may be applied.

DETAILED DESCRIPTION OF SOME EMBODIMENTS

The following embodiments are exemplary. Although the specification may refer to "an", "one", or "some" embodiment(s) in several locations, this does not necessarily mean that each such reference is to the same embodiment(s), or that the feature only applies to a single embodiment. Single features of different embodiments may also be combined to provide other embodiments.

In the following, different exemplifying embodiments will be described using, as an example of an access architecture to which the embodiments may be applied, a radio access architecture based on long term evolution advanced (LTE Advanced, LTE-A) or new radio (NR, 5G), without restricting the embodiments to such an architecture, however. It is obvious for a person skilled in the art that the embodiments may also be applied to other kinds of communications networks having suitable means by adjusting parameters and procedures appropriately. Some examples of other options for suitable systems are the universal mobile telecommunications system (UMTS) radio access network (UTRAN or E-UTRAN), long term evolution (LTE, the same as E-UTRA), wireless local area network (WLAN or WiFi), worldwide interoperability for microwave access (WiMAX), Bluetooth®, personal communications services (PCS), ZigBee®, wideband code division multiple access (WCDMA), systems using ultra-wideband (UWB) technology, sensor networks, mobile ad-hoc networks (MANETs) and Internet Protocol multimedia subsystems (IMS) or any combination thereof.

Figure 1:
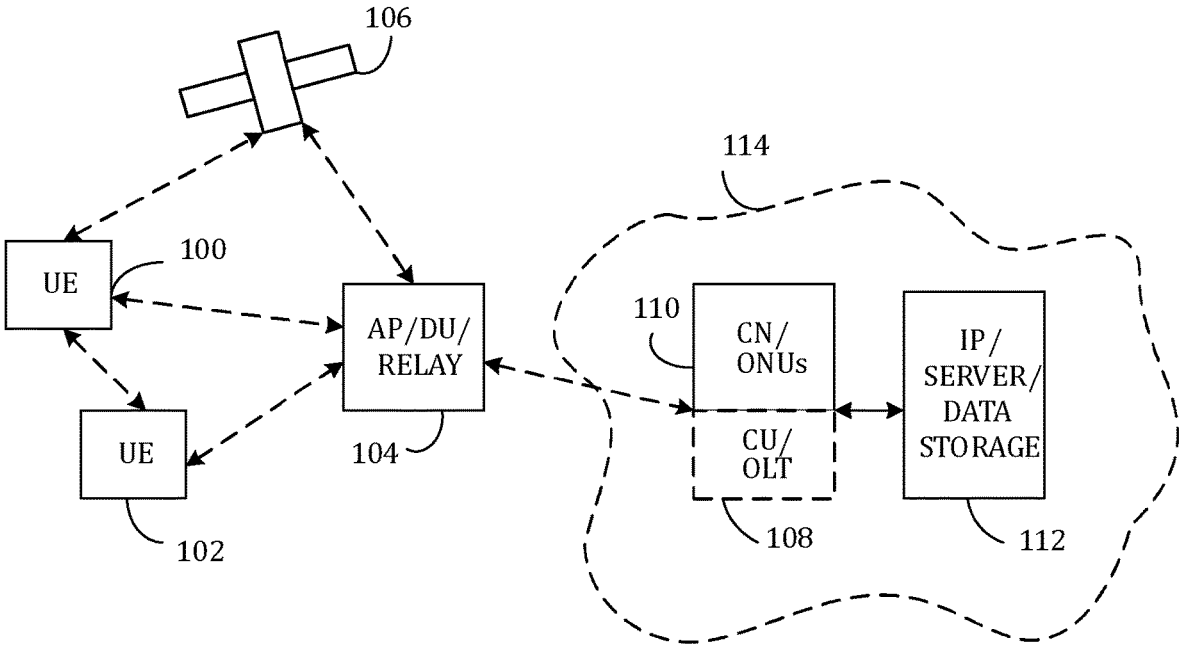

FIG. 1 depicts examples of simplified system architectures only showing some elements and functional entities, all being logical units, whose implementation may differ from what is shown. The connections shown in FIG. 1 are logical connections; the actual physical connections may be different. It is apparent to a person skilled in the art that the system typically comprises also other functions and structures than those shown in FIG. 1.

The embodiments are not, however, restricted to the system given as an example but a person skilled in the art may apply the solution to other communication systems provided with necessary properties.

The example of FIG. 1 shows a part of an exemplifying radio access network.

FIG. 1 shows user devices 100 and 102 configured to be in a wireless connection on one or more communication channels in a cell with an access node (such as (e/g)NodeB) 104 providing the cell. The physical link from a user device to a (e/g)NodeB is called uplink or reverse link and the physical link from the (e/g)NodeB to the user device is called downlink or forward link. It should be appreciated that (e/g)NodeBs or their functionalities may be implemented by using any node, host, server or access point etc. entity suitable for such a usage.

A communications system typically comprises more than one (e/g)NodeB in which case the (e/g)NodeBs may also be configured to communicate with one another over links, wired or wireless, designed for the purpose. These links may be used for signaling purposes. The (e/g)NodeB is a computing device configured to control the radio resources of communication system it is coupled to. The NodeB may also be referred to as a base station, an access point, an access node or any other type of interfacing device including a relay station capable of operating in a wireless environment. The (e/g)NodeB includes or is coupled to transceivers. From the transceivers of the (e/g)NodeB, a connection is provided to an antenna unit that establishes bi-directional radio links to user devices. The antenna unit may comprise a plurality of antennas or antenna elements. The (e/g)NodeB is further connected to core network 110 (CN or next generation core NGC). Depending on the system, the counterpart on the CN side can be a serving gateway (S-GW, routing and forwarding user data packets), packet data network gateway (P-GW), for providing connectivity of user devices (UEs) to external packet data networks, or mobile management entity (MME), etc.

The user device (also called UE, user equipment, user terminal, terminal device, etc.) illustrates one type of an apparatus to which resources on the air interface are allocated and assigned, and thus any feature described herein with a user device may be implemented with a corresponding apparatus, such as a relay node. An example of such a relay node is a layer 3 relay (self-backhauling relay) towards the base station.

The user device typically refers to a portable computing device that includes wireless mobile communication devices operating with or without a subscriber identification module (SIM), including, but not limited to, the following types of devices: a mobile station (mobile phone), smartphone, personal digital assistant (PDA), handset, device using a wireless modem (alarm or measurement device, etc.), laptop and/or touch screen computer, tablet, game console, notebook, and multimedia device. It should be appreciated that a user device may also be a nearly exclusive uplink only device, of which an example is a camera or video camera loading images or video clips to a network. A user device may also be a device having capability to operate in Internet of Things (IoT) network which is a scenario in which objects are provided with the ability to transfer data over a network without requiring human-to-human or human-to-computer interaction. The user device may also utilize cloud. In some applications, a user device may comprise a small portable device with radio parts (such as a watch, earphones or eyeglasses) and the computation is carried out in the cloud. The user device (or in some embodiments a layer 3 relay node) is configured to perform one or more of user equipment functionalities. The user device may also be called a subscriber unit, mobile station, remote terminal, access terminal, user terminal or user equipment (UE) just to mention but a few names or apparatuses.

Various techniques described herein may also be applied to a cyber-physical system (CPS) (a system of collaborating computational elements controlling physical entities). CPS may enable the implementation and exploitation of massive amounts of interconnected ICT (information and communications technology) devices (sensors, actuators, processors microcontrollers, etc.) embedded in physical objects at different locations. Mobile cyber physical systems, in which the physical system in question has inherent mobility, are a subcategory of cyber-physical systems. Examples of mobile physical systems include mobile robotics and electronics transported by humans or animals.

Additionally, although the apparatuses have been depicted as single entities, different units, processors and/or memory units (not all shown in FIG. 1) may be implemented.

5G enables using multiple input-multiple output (MIMO) antennas, many more base stations or nodes than the LTE (a so-called small cell concept), including macro sites operating in co-operation with smaller stations and employing a variety of radio technologies depending on service needs, use cases and/or spectrum available. 5G mobile communications supports a wide range of use cases and related applications including video streaming, augmented reality, different ways of data sharing and various forms of machine type applications (such as (massive) machine-type communications (mMTC), including vehicular safety, different sensors and real-time control. 5G is expected to have multiple radio interfaces, namely below 6 GHz, cmWave and mmWave, and also being integratable with existing legacy radio access technologies, such as the LTE. Integration with the LTE may be implemented, at least in the early phase, as a system, where macro coverage is provided by the LTE and 5G radio interface access comes from small cells by aggregation to the LTE. In other words, 5G is planned to support both inter-RAT operability (such as LTE-5G) and inter-RI operability (inter-radio interface operability, such as below 6 GHz-cmWave, below 6 GHz-cmWave-mmWave). One of the concepts considered to be used in 5G networks is network slicing in which multiple independent and dedicated virtual sub-networks (network instances) may be created within the same infrastructure to run services that have different requirements on latency, reliability, throughput and mobility.

The current architecture in LTE networks is fully distributed in the radio and fully centralized in the core network. The low latency applications and services in 5G require to bring the content close to the radio which leads to local break out and multi-access edge computing (MEC). 5G enables analytics and knowledge generation to occur at the source of the data. This approach requires leveraging resources that may not be continuously connected to a network such as laptops, smartphones, tablet computers and sensors. MEC provides a distributed computing environment for application and service hosting. It also has the ability to store and process content in close proximity to cellular subscribers for faster response time. Edge computing covers a wide range of technologies such as wireless sensor networks, mobile data acquisition, mobile signature analysis, cooperative distributed peer-to-peer ad hoc networking and processing also classifiable as local cloud/fog computing and grid/mesh computing, dew computing, mobile edge computing, cloudlet, distributed data storage and retrieval, autonomic self-healing networks, remote cloud services, augmented and virtual reality, data caching, Internet of Things (massive connectivity and/or latency critical), critical communications (autonomous vehicles, traffic safety, real-time analytics, time-critical control, healthcare applications).

The communication system is also able to communicate with other networks, such as a public switched telephone network or the Internet 112, or utilize services provided by them. The communication network may also be able to support the usage of cloud services, for example at least part of core network operations may be carried out as a cloud service (this is depicted in FIG. 1 by "cloud" 114). The communication system may also comprise a central control entity, or a like, providing facilities for networks of different operators to cooperate for example in spectrum sharing.

Edge cloud may be brought into radio access network (RAN) by utilizing network function virtualization (NVF) and software defined networking (SDN). Using edge cloud may mean access node operations to be carried out, at least partly, in a server, host or node operationally coupled to a remote radio head or base station comprising radio parts. It is also possible that node operations will be distributed among a plurality of servers, nodes or hosts. Application of cloudRAN architecture enables RAN real time functions being carried out at the RAN side (in a distributed unit, DU 104) and non-real time functions being carried out in a centralized manner (in a centralized unit, CU 108).

It should also be understood that the distribution of labor between core network operations and base station operations may differ from that of the LTE or even be non-existent. Some other technology advancements probably to be used are Big Data and all-IP, which may change the way networks are being constructed and managed. 5G (or new radio, NR) networks are being designed to support multiple hierarchies, where MEC servers can be placed between the core and the base station or nodeB (gNB). It should be appreciated that MEC can be applied in 4G networks as well.

5G may also utilize satellite communication to enhance or complement the coverage of 5G service, for example by providing backhauling. Possible use cases are providing service continuity for machine-to-machine (M2M) or Internet of Things (IoT) devices or for passengers on board of vehicles, or ensuring service availability for critical communications, and future railway/maritime/aeronautical communications. Satellite communication may utilize geostationary earth orbit (GEO) satellite systems, but also low earth orbit (LEO) satellite systems, in particular mega-constellations (systems in which hundreds of (nano)satellites are deployed). Each satellite 106 in the mega-constellation may cover several satellite-enabled network entities that create on-ground cells. The on-ground cells may be created through an on-ground relay node 104 or by a gNB located on-ground or in a satellite.

It is obvious for a person skilled in the art that the depicted system is only an example of a part of a radio access system and in practice, the system may comprise a plurality of (e/g)NodeBs, the user device may have an access to a plurality of radio cells and the system may comprise also other apparatuses, such as physical layer relay nodes or other network elements, etc. At least one of the (e/g)NodeBs or may be a Home(e/g)nodeB. Additionally, in a geographical area of a radio communication system a plurality of different kinds of radio cells as well as a plurality of radio cells may be provided. Radio cells may be macro cells (or umbrella cells) which are large cells, usually having a diameter of up to tens of kilometers, or smaller cells such as micro-, femto- or picocells. The (e/g)NodeBs of FIG. 1 may provide any kind of these cells. A cellular radio system may be implemented as a multilayer network including several kinds of cells. Typically, in multilayer networks, one access node provides one kind of a cell or cells, and thus a plurality of (e/g)NodeBs are required to provide such a network structure.

For fulfilling the need for improving the deployment and performance of communication systems, the concept of "plug-and-play" (e/g)NodeBs has been introduced. Typically, a network which is able to use "plug-and-play" (e/g)Node Bs, includes, in addition to Home (e/g)NodeBs (H(e/g)nodeBs), a home node B gateway, or HNB-GW (not shown in FIG. 1). A HNB Gateway (HNB-GW), which is typically installed within an operator's network may aggregate traffic from a large number of HNBs back to a core network.

In some embodiments, the system illustrated in FIG. 1 may be a system for realizing Fixed Wireless Access (FWA) (equally called Fixed Wireless Broadband). In said embodiments, the user devices 100, 102 may comprise one or more customer premises equipment (CPE) being configured to connect to at least one access point 104 (or an access unit) according to fixed wireless access technology. Broadly, CPE may comprise any communications equipment that reside on the premises of a user (e.g., a house or a building of the user). CPE may comprise, for example, one or more of telephones, routers, network switches, residential gateways (RG), set-top boxes, fixed mobile convergence products, home networking adapters and/or Internet access gateways that enable consumers to access services provided by communications service providers and distribute them around their house via a local area network. The connection to and from the access point 104 may be provided for each CPE by one or more indoor and/or outdoor antennas connected to or comprised in said CPE using fixed wireless access technology. Each CPE and the corresponding antenna(s) may comprise equipment purchasable and installable by the user and/or equipment that need to be provided and installed by a particular service provider or operator.

In embodiments pertaining to FWA, the element 114 may correspond to or comprise a fiber access network or a passive optical network (PON). Further, elements 110 and/or 108 may form a central part of the fiber access network 114 and may comprise one or more optical network units (ONU) and one or more optical line terminations (OLT). Each OLT may be connected to one or more ONUs (typically, to a plurality of ONUs). The ONU(s) may be used to convert electrical signals received from the access point 104 to optical signals to be transmitted via an optical fiber to an OLT and vice versa while the OLT(s) may be used to control the information in the fiber access network.

As described above millimeter-wave communications will be a vital part of the forthcoming fifth generation (5G) wireless communication systems. While millimeter waves (i.e., electromagnetic waves belonging to Extremely High Frequency, EHF, range) are potentially able to provide very high throughputs for communication, they have the fundamental disadvantage of having substantially larger propagation losses compared to, for example, centimeter waves (i.e., electromagnetic waves belonging to Super High Frequency, SHF, range) and especially low centimeter or even decimeter wave frequencies used in the current generation communications systems. In addition to increased free-space path loss, the penetration loss, for example, through brick walls, concrete walls and windows, is also significantly increased at millimeter waves compared to centimeter waves. These factors have to be taken into account in the design of any transmitters, receivers or transceivers operating at millimeter waves. In terms of CPEs working at millimeter wave frequencies, said adverse effects may be compensated for by having a CPE located inside a building and an antenna connected to said CPE located outside the building. For example, the antenna may be installed on the outside wall of the building, preferably near a window, or on a surface of the window. This way the significant penetration loss due to the wall and/or window of the building may be avoided.

However, this approach presents its own challenges. When using an outdoor antenna, a connectivity of the outdoor antenna to the indoor CPE has to be provided. One conventional solution is to provide an outdoor box (i.e., outdoor equipment) comprising the antenna itself as well as a radio transceiver which provides a connection with the CPE either in baseband or using an intermediate frequency. The connection is achieved either using wired means such as a coaxial cable or other type of cable/waveguide or via wireless link (e.g., a radio link or an optical link). Said link may further be used to power the external box.

While the aforementioned solution solves the problem of how to provide a connection between the CPE and the outdoor antenna, thus also providing a solution to the problem of the high penetration losses at millimeter waves, the complexity of the solution is considerable as the solution necessitates a plurality of communication equipment to be installed outside a corresponding building in addition to the installation of the indoor CPE. Moreover, the installation of the necessary equipment often requires that one or more holes are drilled to an external wall or window frame to provide a pass-through for a cable. Thus, the installation of the necessary equipment (especially outdoor equipment) may be difficult or even impossible in some cases without professional installers. A solution where all the equipment could be installed inside the building (possibly by the user himself/herself without necessitating a truck roll) would, thus, provide a much simpler and less time-consuming alternative. This type of approach is common at lower frequencies (e.g., sub 6 GHz frequencies) where the penetration losses do not pose a significant problem but is much more demanding at millimeter wave frequencies due to the high gain required for the indoor antenna to compensate for the penetration loss and is thus rarely implemented.

Figure 2A:
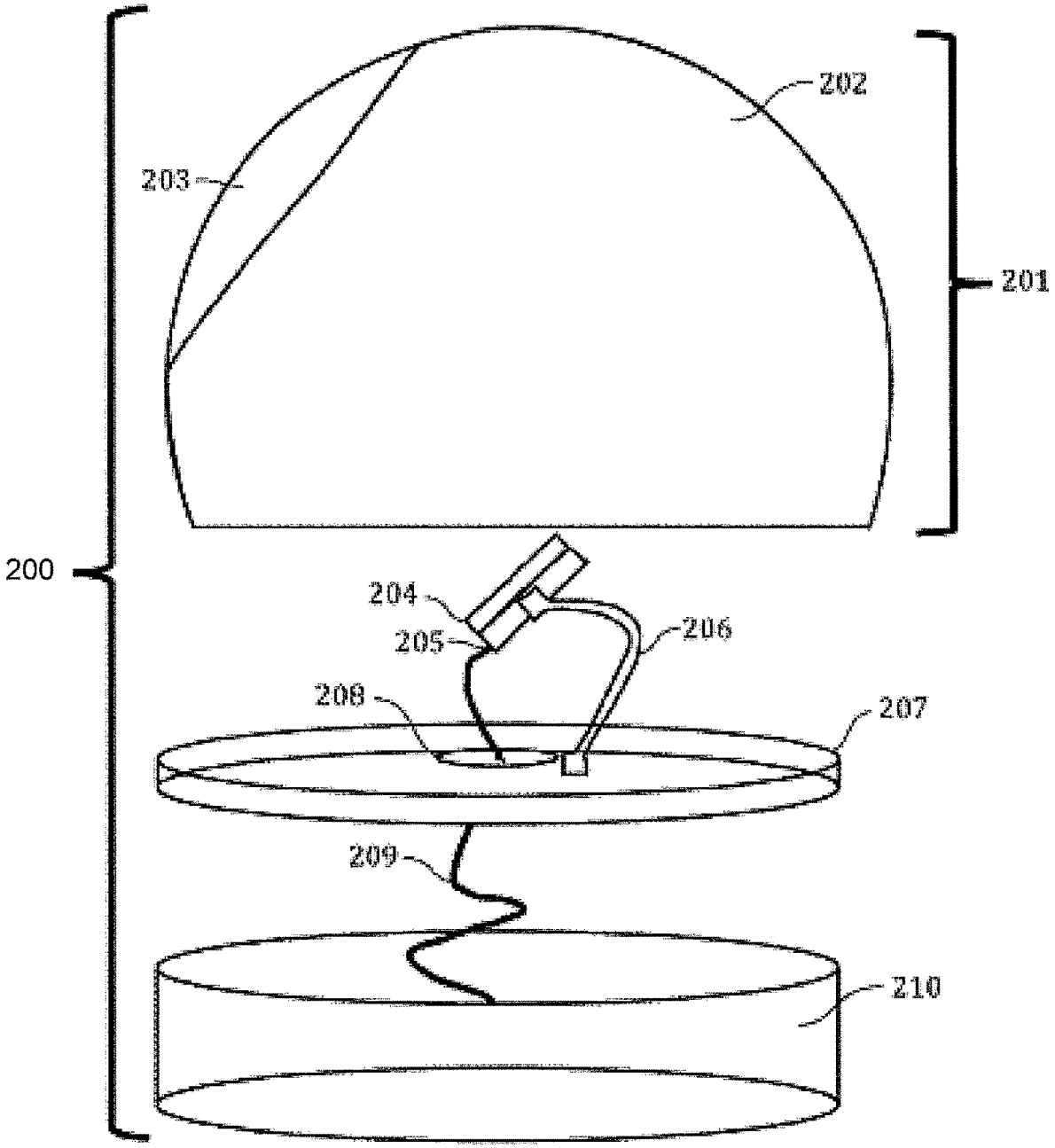
FIGS. 2A, 2B, 2C, 2D, 3A, 3B, 3C, 4A, 4B and 5 illustrate examples of antenna arrangements according to embodiments.
Figure 2B:
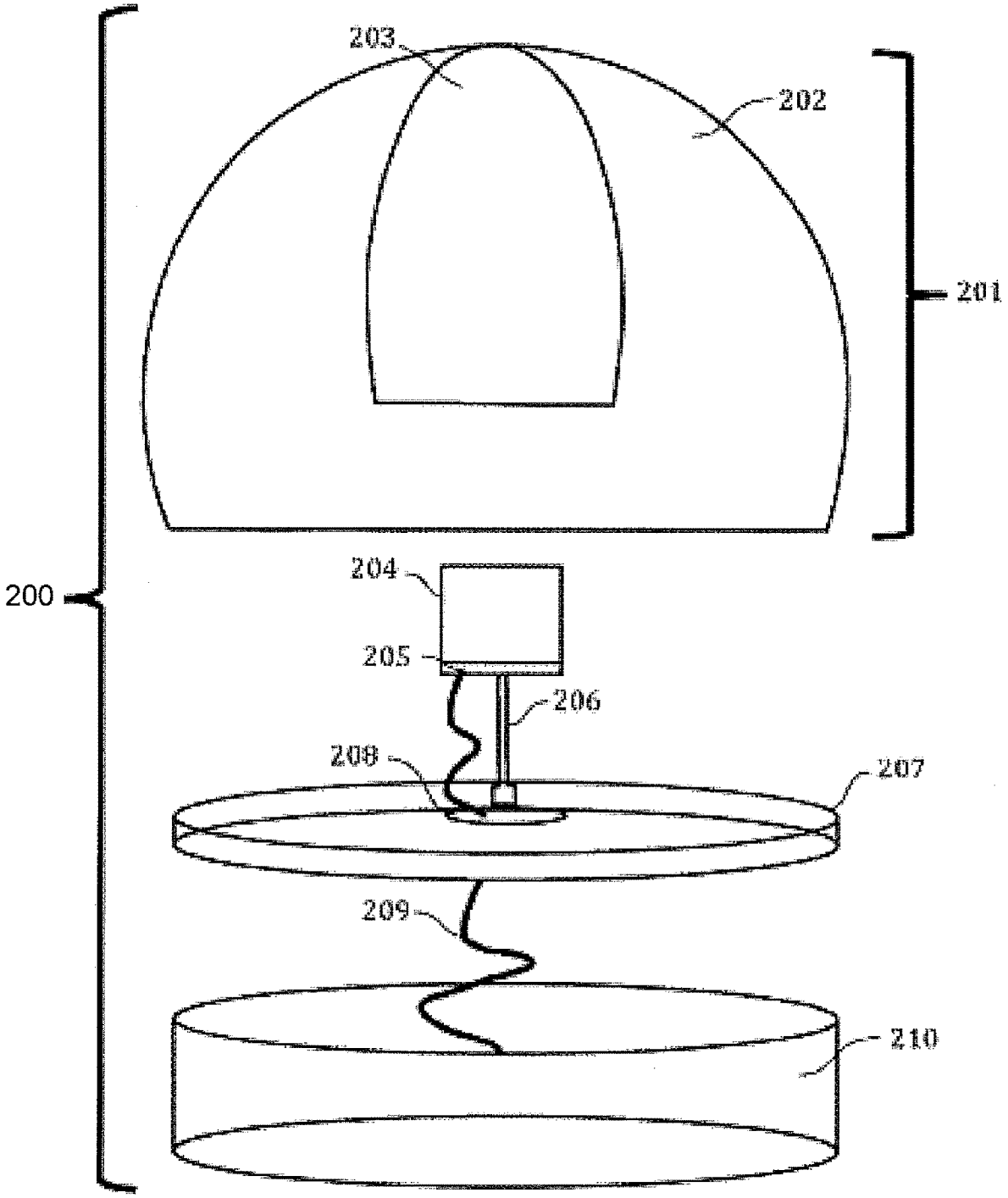
Figure 2C:
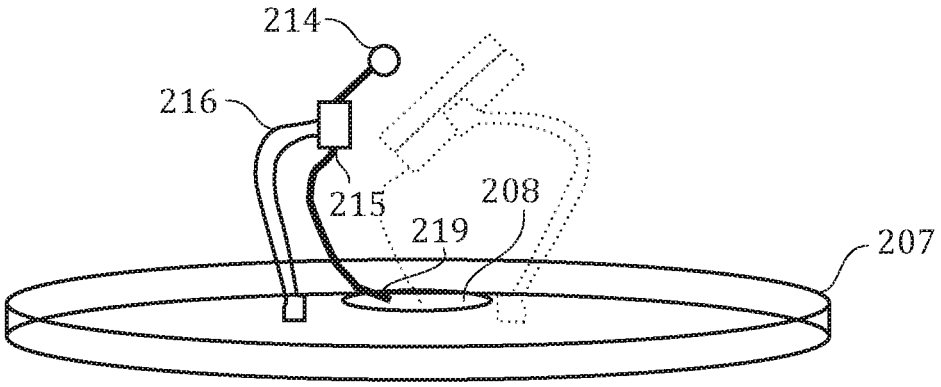
Figure 2D:
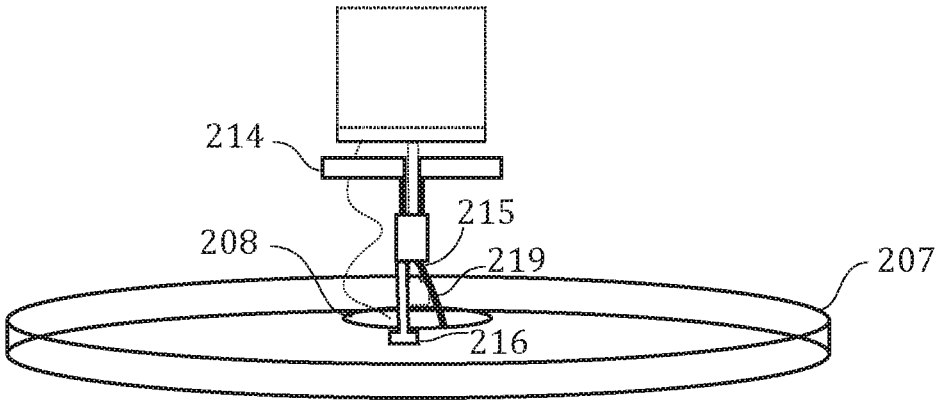

FIGS. 2A and 2B illustrate an antenna arrangement 200 according to an exemplary embodiment in an exploded view drawing from two different perspectives, namely from the side (FIG. 2A) and from the front (FIG. 2B). Furthermore, FIGS. 2C and 2D illustrate a partial side and front views of the same antenna arrangement 200 according to an exemplary embodiment illustrating in particular a second feed antenna 214 not shown in FIGS. 2A and 2B for clarity. The illustrated antenna arrangement 200 may be used indoors and may provide high enough gain to compensate for the penetration loss of walls and windows at millimeter (and centimeter) wave frequencies in the CPE communications scenario discussed above. The illustrated antenna arrangement 200 may correspond to the CPE with the CPE electronics (i.e., circuitry) comprised within the base 210 of the antenna arrangement 200.

The antenna arrangement 200 comprises at least two elements: one or more feed antennas (one of which is shown in FIGS. 2A and 2B as element 204 and another in FIGS. 2C and 2D as element 214) adapted to transmit and receive radio signals and an antenna radome 201 arranged around said one or more feed antennas 204, 214. A section 203 of the antenna radome 201 may be implemented as an antenna reflector for the one or more feed antennas 204, 214. In other words, the antenna radome may be adapted to redirect electromagnetic energy provided by said at least one of the one or more feed antennas 204, 214 such that the gain of the antenna arrangement 200 to a particular direction (e.g., direction of the access node) is increased. Due to the fundamental principle of reciprocity in antennas, an inverse effect is observed in reception. In other words, the antenna radome 203 is thus adapted also to redirect electromagnetic energy from said particular direction (e.g., from the access node) to the one or more feed antennas 204, 214. The antenna arrangement 200 may further comprise a flat base 210, a platform 207 with a hole 208, one or more antenna support structures 206, one or more feed lines 209 and corresponding one or more feed ports 205 to be discussed in detail below.

The one or more feed antennas 204, 214 may comprise one or more feed antennas of different type, different operational frequency band, different directive behavior (e.g., directive and omnidirectional antennas) and/or different polarization (e.g., vertical, horizontal, left-handed circular, and/or right-handed circular polarization). All or only some of the one or more feed antennas 204, 214 may be adapted to utilize the antenna radome 201 as a reflector for improving the achievable gain. The one or more feed antennas 204, 214 may comprise, for example, one or more feed antennas of the following types: a dipole antenna, a bowtie dipole antenna, a folded dipole antenna, a crossed dipole antenna, a monopole antenna, a horn antenna, a horn lens antenna, a loop antenna, a log-periodic antenna, a slotted antenna and a slotted array antenna.

The one or more feed antennas 204, 214 may be supported by one or more antenna support structures 206, 216 (e.g., antenna stands). Each antenna support structure 206, 216 may be fixed to the platform 207 and/or the flat base 210. Each antenna support structure 206, 216 may be manufactured from a nonmetallic material to avoid unwanted reflections which could deteriorate the performance (e.g., the shape of the produced antenna patterns) of the antenna arrangement 200. In some embodiments, the one or more antenna support structures 206, 216 may be adjustable as will be described in detail in relation to FIG. 5.

The one or more feed antennas 204, 214 may further comprise one or more array antennas and/or one or more phased array antennas. An array antenna (or an antenna array) is a set of connected antennas (or antenna elements) which work together as a single antenna, to transmit or receive radio waves while a phased array antenna is an array antenna where the phase of each signal fed to each antenna element of the array may be independently tuned using a phase shifter to provide electronical steering of the antenna beam direction without moving the array antenna. Each (phased) array antenna comprised in the one or more feed antennas 204, 214 may comprise one or more antenna elements such as planar or curved patch antenna elements of different shapes (e.g., rectangular, circular, elliptical, cross-shaped, ring-shaped), other microstrip-based (i.e., printed) antenna elements, dipoles, folded dipoles, bowtie dipoles, monopoles and loops.

In an embodiment, the one or more feed antennas comprise a first feed antenna 204 adapted to operate at a first frequency band and a second feed antenna 214 adapted to operate at a second frequency band. The first frequency band and the second frequency band may be discontiguous with each other, that is, the first and second frequency bands may not overlap. The first frequency band may comprise at least one millimeter wave frequency (i.e., a frequency between 30 and 300 GHz) or a high centimeter wave frequency (e.g., a frequency between 14 and 30 GHz) while the second frequency band may consist of frequencies below the first frequency band of the first feed antenna 204. According to an embodiment, the first frequency band comprises at least one frequency above 20 GHz and below 100 GHz and the second frequency band comprises at least one frequency above 1 GHz and below 6 GHz. Specifically, the first frequency band may comprise one of 28 GHz, 38 GHz, 39 GHz and 60 GHz and/or the second frequency band may comprise one of 3.6 GHz and 5 GHz. In an embodiment, the first feed antenna is adapted to operate at one of the frequency bands targeted for millimeter wave communication comprising a 28 GHz band (27.5-28.35 GHz or even 24.25-29.5 GHz), a 38 GHz band (37-40 GHz), a 39 GHz band (38.6-40 GHz) and a 60 GHz band (57-64 GHz). The exact frequency ranges to be used in 5G communications systems in different countries are yet to be determined and thus the frequency ranges given in parentheses should be considered only as examples. The first feed antenna 204 may utilize any of said bands fully or partly.

In some embodiments, the first feed antenna may be configured to be compatible with IEEE802.11ad (60 GHz Wireless Gigabit Alliance, 60 GHz WiGig). Thus, the first frequency band may comprise fully or partly one or more of the globally available 60 GHz unlicensed bands, namely 57.05-64.00 GHz, 57.00-64.00 GHz, 57.00-66.00 GHz, 59.00-64.00 GHz, 59.00-66.00 GHz, 59.4-62.90 GHz. In some embodiments, the second feed antenna is adapted to operate at the so-called Citizens Broadband Radio Service (CBRS) band (3.55-3.70 GHz) or in a subband of said band. Alternatively, another frequency band within the range of 3.4 GHz to 3.8 GHz may be used by the second feed antenna such as the TD 3500 frequency band (3.4-3.6 GHz) or the TD 3700 frequency band (3.6-3.8 GHz) as specified by 3GPP. In some embodiments, the second feed antenna is adapted to operate at a 5 GHz frequency band (i.e., a frequency band within the range of 5.0-5.9 GHz) or in a subband of such a band.

Figure 3A:
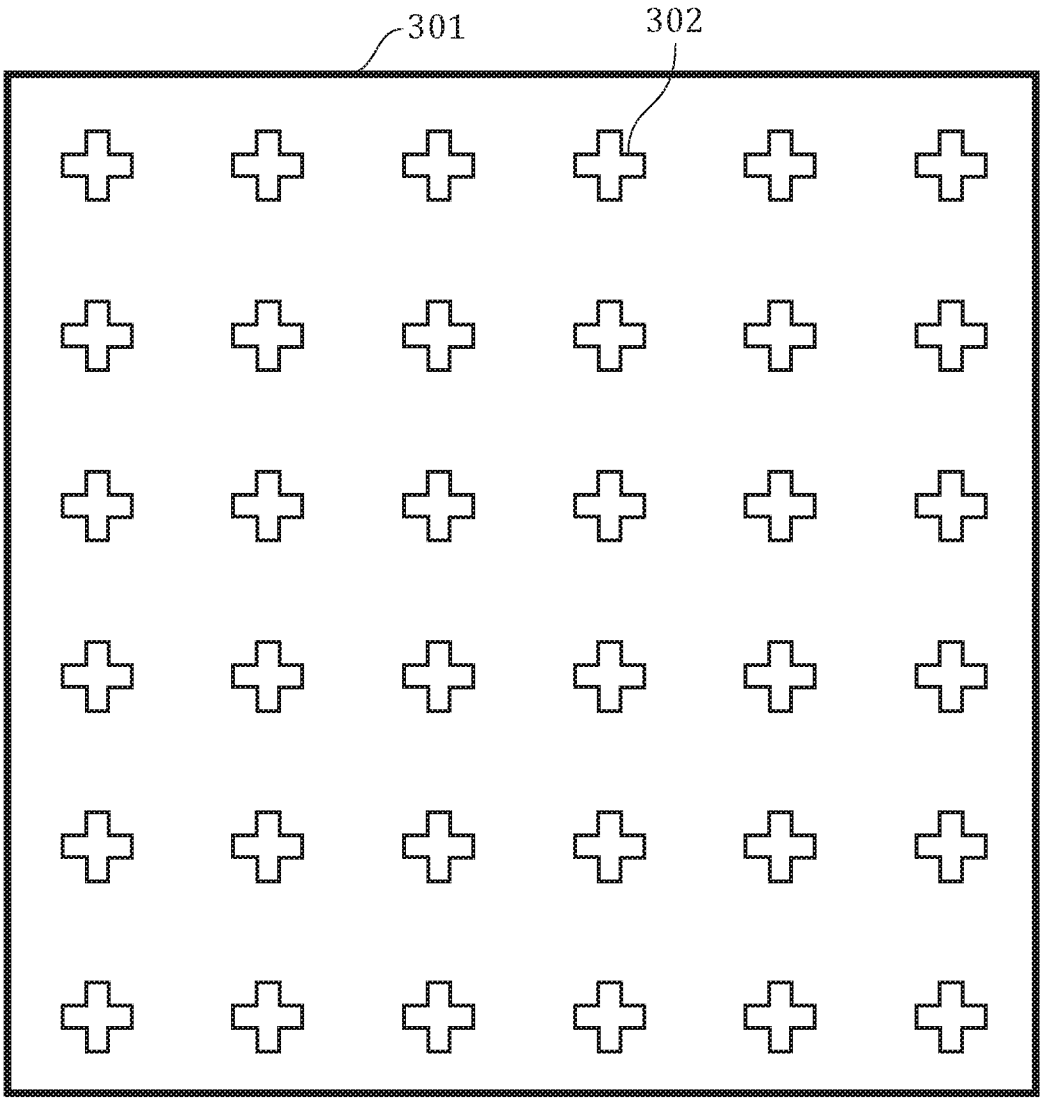
Figure 3B:
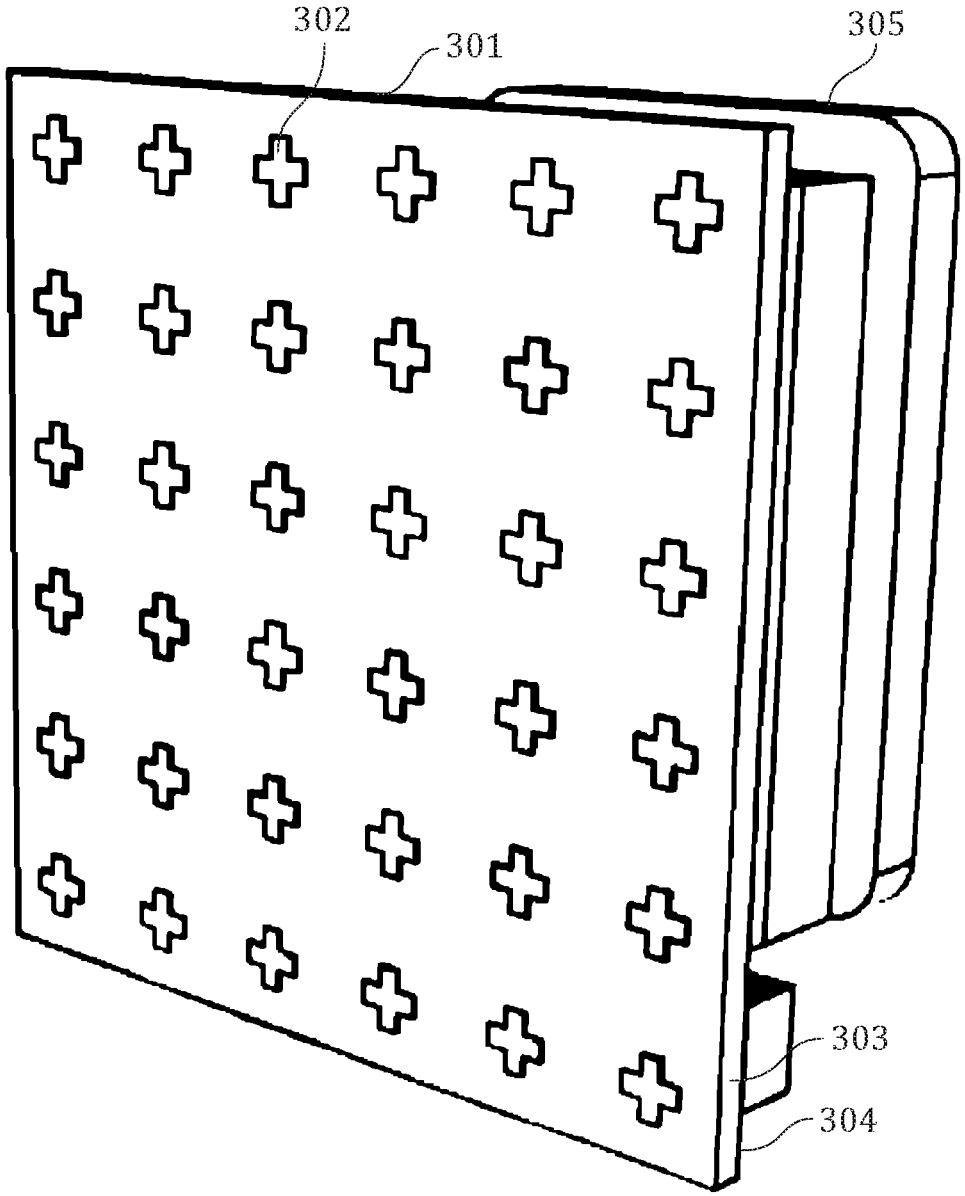
Figure 3C:
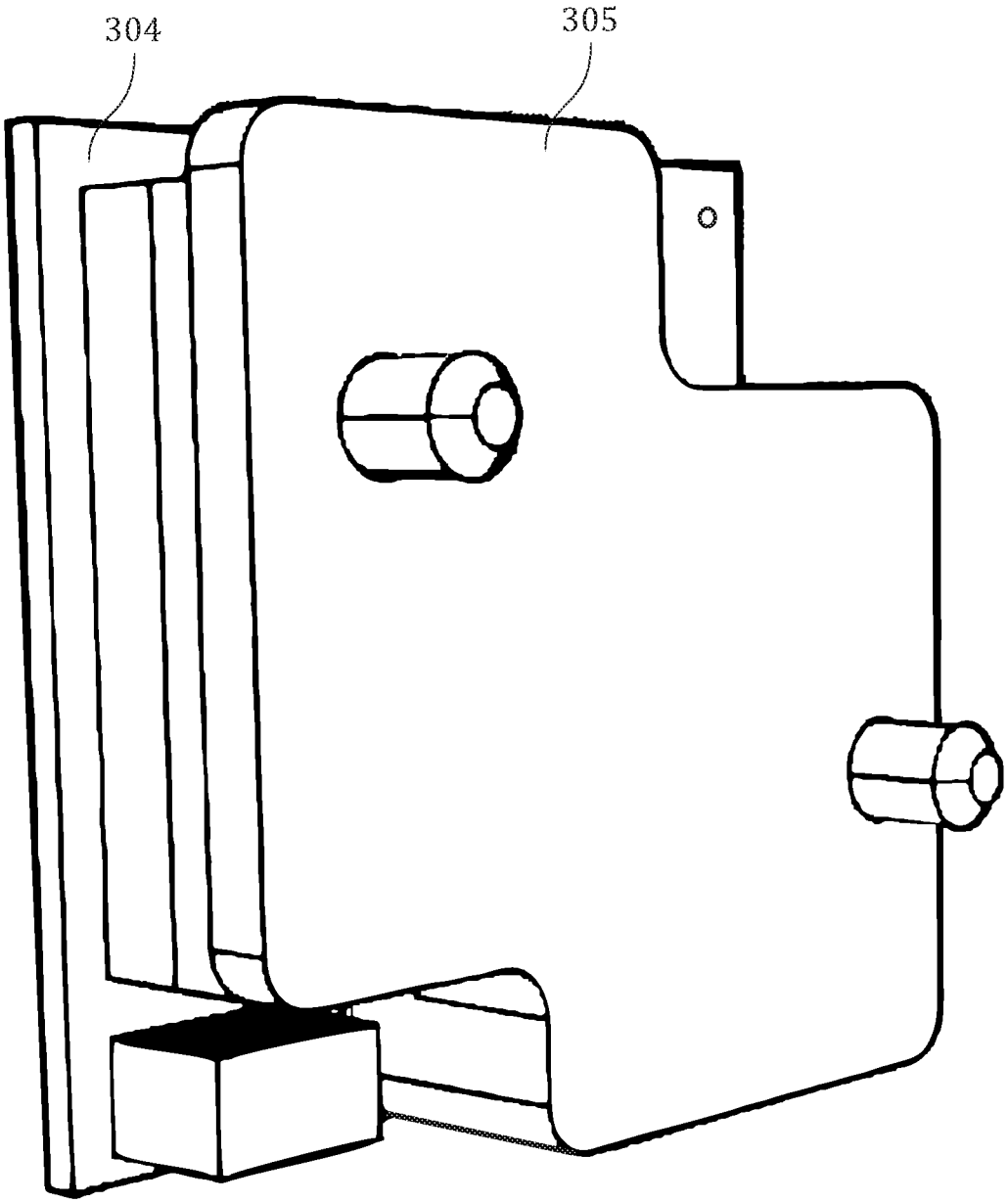

In an embodiment, the first feed antenna 204 is either one-dimensional or two-dimensional planar phased array antenna comprising one or more antenna elements. Specifically, the one or more antenna elements may be microstrip antenna elements (i.e., printed antenna elements), for example, patch antenna elements. A simplified geometry of an exemplary two-dimensional planar phased array acting as the first feed antenna 204 is shown in FIGS. 2A and 2B. A more detailed example geometry is shown in FIGS. 3A, 3B and 3C and discussed later in relation to said Figures.

The second feed antenna 214 may be either one-dimensional or two-dimensional planar phased array antenna comprising one or more antenna elements similar to the first feed antenna, a patch antenna or a dipole antenna. Due to the requirement of high gain especially at millimeter wave frequencies and scaling down of the size of a resonant patch with increasing frequency, the second feed antenna, if realized as an array antenna, may comprise only a few antenna elements (e.g., four patch antenna elements) while the first feed antenna may comprise a much larger number of patch antenna elements (e.g., tens of patch antenna elements as shown in FIGS. 2A, 3B and 3C).

In FIGS. 2C and 2D, an exemplary second feed antenna 214, namely a dipole antenna, and its location on the platform 207 and the first feed antenna 204 (shown with a dotted line for clarity) is shown. The dipole antenna 214 may be a half-wave dipole (a dipole having a length of approximately one half of the wavelength at the operational frequencies) which provides an omnidirectional radiation pattern. In the illustrated example, the dipole antenna is connected to the feed line 219 via a balun 215 which is a device for converting a balanced signal (in this case, the signal in the feed line 219 such as a coaxial cable) and an unbalanced signal (a signal feeding the dipole antenna 204). The balun 215 may be, for example, a bazooka or sleeve balun.

In some alternative embodiments, the first feed antenna 204 may be a horn antenna or a horn lens antenna (i.e., a horn antenna with an integrated lens to improve gain). The second feed antenna may, alternatively, be any antenna as listed above such as a dipole antenna, a monopole antenna and a horn antenna if space within the antenna radome allows for it.

As mentioned above, the antenna arrangement 200 may comprise one or more feed lines 209, 219. Each feed line 209, 219 may be connected to one of the one or more feed antennas 204 enabling feeding said one of the one or more feed antennas 204, 214. In other words, each feed line may feed one of the one or more feed antennas with a first signal which is subsequently transmitted by the antenna (assuming that the first signal is within the operational frequency band of said one of the one or more feed antennas). Conversely, said feed line 209, 219 may receive a second signal received by said one of the one or more feed antennas 204, 214. Each feed line 209, 219 may be connected a feed point or feed port 205 of the corresponding feed antenna (i.e., a part of the antenna adapted to receive a signal such that the antenna is excited and thus causes transmission of said signal). The one or more feed lines 209, 219 may be, for example, coaxial cables.

As previously mentioned, a section of the antenna radome 201 may be implemented as an antenna reflector for the one or more feed antennas 204, 214. To achieve this functionality, the antenna radome may comprise two sections: a metallic section 203 and a nonmetallic section 202. Specifically the metallic section may enable the antenna radome to act as an antenna reflector for said at least one of the one or more feed antennas 204 while the nonmetallic section may allow radio waves, at least at a frequency range comprising operational frequencies of the one or more feed antennas 204, to penetrate it with only minimal attenuation (i.e., operate similar to a conventional antenna radome). The antenna radome 201 may be realized by providing a conventional antenna radome made out of, for example, polyurethane or polypropylene and metallizing (i.e., coating with metal) certain surface area of the outer and/or inner surface of the antenna radome 201 to produce the metallic (or metallized in this case) section 203. Alternatively, the metallic section 203 may be a separate metallic part (or element) shaped so as to provide the functionality of an antenna reflector and fixed to the antenna radome 201 (that is, to a conventional nonmetallic antenna radome). In this case, the antenna radome 201 may be fixed to the inner or outer surface of the antenna radome 201. In some embodiments, a hole may be provided in the antenna radome 201 for the metallic section 203.

The antenna radome 201 may have a shape of a spherical hollow dome as shown in the illustrated example or a cut parabolic shape or a combination of the two. The antenna radome 201 may be relatively thin so as not cause significant attenuation by its nonmetallic section 202. A spherical dome may be defined as a portion of a sphere cut off by a plane. The height of the dome may be equal to the radius of the sphere (a hemisphere), smaller than the radius of the sphere (a spherical cap) or larger than the radius of the sphere but smaller than the diameter of the sphere. Correspondingly, the metallic section 203 may have a shape of a section cut out of a spherical surface or a parabolic shape. In the former case, if the metallic section 203 comprises a relatively small area of the surface of the spherical dome (as in the illustrated example of FIGS. 2A and 2B), the metallic section 203 may be considered approximately parabolic (or quasi-parabolic) due to the fact that in such a case the shape of the metallic section approximates the shape of a parabolic surface. In this case, the metallic section 203 acting as a spherical reflector (i.e., a spherical mirror for radio waves) focuses the radio waves reflected from it to a single focal point similar to a parabolic reflector but in a slightly imperfect way. In other words, the waves reflecting from different parts of the metallic section 203 focus at slightly different positions. This effect is called spherical aberration. The effect of the spherical aberration to the performance of the reflector is, however, small or negligible if all the waves reflect from a small area of the spherical surface (small relative to the area of the sphere) as discussed above.

In some embodiments, the antenna radome 201 may have a shape of a polyhedron approximating the aforementioned antenna radome shapes. Similarly, the metallic section 201 may correspond to a polyhedral approximation of a spherical or parabolic surface.

In order to achieve focusing of the radio waves received/transmitted by the one or more feed antennas 204, 214, the one or more feed antennas 204, 214 (or specifically their phase centers) may be arranged at the focal point of the metallic section 203 (i.e., the antenna reflector) or at least in close proximity of the focal point of the metallic section 203. The term "in close proximity" may be understood here as a location distance of which to the focal point is small enough so that the decrease in antenna efficiency due to non-ideal feed phase center is within reasonable limits for a given application. In other words, the antenna arrangement may behave as one or more offset parabolic reflector antennas with a shared parabolic reflector 203, each feed antenna 204, 214 forming its own offset parabolic reflector antenna with the parabolic reflector 203. In the illustrated antenna arrangement 200, the focal point of the metallic section 203 is assumed to be roughly in the center of the antenna radome 201 at least on a horizontal plane (when the antenna radome 201 is lowered to meet the platform 207). The horizontal plane may be defined as a plane orthogonal to a direction of height of the antenna radome. Thus, the first and second feed antennas 204, 214 (or specifically the phase centers of the first and second feed antennas) are located in the focal point or at least near the focal point. In other embodiments, the antenna radome 201 and specifically the metallic section 203 may be adapted to provide a focal point at a different position within the antenna radome 201 (at the horizontal center of the antenna radome 201 or horizontally off-center and at different heights relative to the flat base 210 or the platform 207) or at a position on the inner or outer surface of the antenna radome. An example of the latter scenario is discussed in detail in relation to FIGS. 4A and 4B.

The metallic section 203 of a spherical antenna radome may be behave as (quasi-) parabolic reflector in view of a certain feed antenna 204, 214 even if the area of the metallic section 203 is large as long as the beam of the feed antenna 204, 214 illuminates only a small area of the surface of the metallic section 203. According to some embodiments, the metallic section 203 covers less than half of a surface area of the antenna radome. If more than half of the surface area of the antenna radome 201 is covered by the metallic section 203, the metallic section 203 may cause blockage of received/transmitted radio signal or unwanted reflections, thus deteriorating the gain pattern (or the directivity pattern) of the feed antenna.

The area of metallic section 203 along the surface of the antenna radome may have a shape of a cut ellipse as illustrated in FIGS. 2A and 2B. In other embodiments, other shapes may be used such a parabolic shape, a full ellipse, a circle, a cut circle, a rectangle or a polygon.

The dimensions of the metallic section 203 may be defined based on the second feed antenna (or in general, by one of the one or more feed antennas 204, 214 operating at the lowest frequency band). For example, if the second feed antenna 214 has a frequency band around 5 GHz, the parabolic reflector 203 (i.e., the metallic section) may have a diameter of 12 cm which corresponds to two times the free-space wavelength at 5 GHz. Said diameter may be used for the vertical and/or horizontal dimension of the metallic section 203. The relationship between the diameter D, the depth d and the focal distance f of the metallic section may be defined through $d-=(D/2)^2/(4f)$.

In some embodiments, the metallic section 201 may have a flat surface. In such a case, the metal section 201 (acting as a simple mirror for radio waves) is not able to provide focusing as in the case of a parabolic reflector. However, the gain of the one or more feed antennas 204, 214 may still be improved. For example, a gain of a dipole antenna (or other omnidirectional antenna) may be improved by placing at a distance of quarter wavelength from a metal sheet. Obviously, if no focal point may be defined for the antenna reflector, the separation between the antenna reflector and the one or more feed antennas 204, 214 may be different for each of the feed antennas depending on the frequency band of said feed antenna.

The antenna radome 201 and the one or more feed antennas 204 supported by the one or more support structures 206, 216 may be arranged on a platform 207 which may be supported a flat base 210. The platform 207 may have a hole 204 (or one or more holes) in proximity of the one or more feed antennas 204. Said hole 204 may enable the one or more feed lines 209 connected via the one or more feed ports 205 to the one or more feed antennas 204 to pass through to the flat base 210 which may be hollow. The other end of each feed line 209 may be connected to a radio transceiver (possible located inside the flat base 210). The flat base 210 may further comprise one or more circuitry configured to implement one or more CPE functionalities. Said one or more circuitry may comprise the aforementioned transceiver or be connected to it. The platform 207 and the flat base 210 may be made of metallic (i.e., reflective) or nonmetallic (i.e., non-reflective) material. In some embodiments, the platform 207 may be rotatable independent of the flat base 210 as will be described in detail in relation to FIG. 5.

FIGS. 3A, 3B and 3C illustrate an exemplary antenna operating at millimeter wave frequency band or high centimeter wave frequency band from directly above, in a perspective view from above and in a perspective view from below, respectively. The illustrated antenna may correspond to the antenna 204 of FIGS. 2A and 2B.

Referring to FIGS. 3A, 3B and 3C, the antenna 301 is a microstrip-based (i.e., printed) two-dimensional (phased) array antenna 301 (or antenna array) comprising 6×6 antenna elements 302. The antenna elements 302 are printed on a substrate 303 backed by a metallic ground plane 304 (i.e., on a slab of a dielectric material other side of which is fully metallized). The illustrated antenna array may be printed using any established printed circuit board (PCB) technology. In the illustrated example, each antenna element 302 has a shape of a cross though other shapes (e.g., rectangular) may be equally used in other embodiments.

Depending on the phases of the signals fed to each individual antenna element 302 relative to each, the main beam of the phased array antenna 301 may be directed to a broadside direction (a direction orthogonal to the plane of the array) or to a particular direction between the broadside direction and endfire directions (directions along the plane of the array). The illustrated antenna 301 may be a phased array antenna where the beam direction may be electrically steered by changing phases of the signals fed to each antenna element 302 or it may be a (non-phased) array antenna where different phase shifts may be imposed on signals fed to each antenna element 302 using phase shifters but no electrical tuning of said phases is possible. The element 305 may form a hollow cavity which may comprise the circuitry configured to realize the necessary phase shifting.

As efficient transmission, amplification, modulation and other manipulation of millimeter wave signals is considerably more demanding than performing corresponding operations for lower radio frequencies (e.g., at 3 GHz) where mature technological solutions are widely available, it is often preferably to convert the signal to be transmitted to the wanted millimeter frequency band only right before feeding the signal to the millimeter wave antenna. Said conversion may be performed by mixing the intermediate frequency (IF), i.e., the signal of interest, in a radio frequency (RF) mixer with a local oscillator frequency to produce a signal with the wanted millimeter wave frequency to be transmitted. To give an example, the intermediate frequency may be defined as a frequency range of 1 to 5 GHz, the local oscillator frequency may be 14.5 GHz and the feed antenna has an operational bandwidth of 59 GHz-63 GHz. When the IF signal and the LO signal are fed to a RF mixer, the resulting output signal comprises a set of harmonic frequencies (i.e., $f_{LO}$, $f_{IF}$, $|f_{LO}\pm f_{IF}|$, $|2f_{LO}+f_{IF}|$, $|f_{IF}+2f_{LO}|$, . . . ). One of said harmonic frequencies is $4f_{LO}+f_{IF}$.=59 GHz-63 GHz, i.e., the signal to be transmitted. The other harmonic frequencies may be filtered using a passband filter. The hollow cavity of the element 305 may further comprise circuitry configured to perform the described conversion of an intermediate frequency to the wanted millimeter wave frequency (e.g., 60 GHz). The element 305 may also act as a heatsink for said circuitry.

For providing an operational frequency band around 60 GHz, the size of the 6×6 array antenna 301 may be approximately 2 cm×2 cm. By scaling the dimensions of the antenna 301 up or down, similar antenna design may be used for any other higher millimeter wave frequency or lower millimeter or centimeter wave frequency, respectively.

Figure 4A:
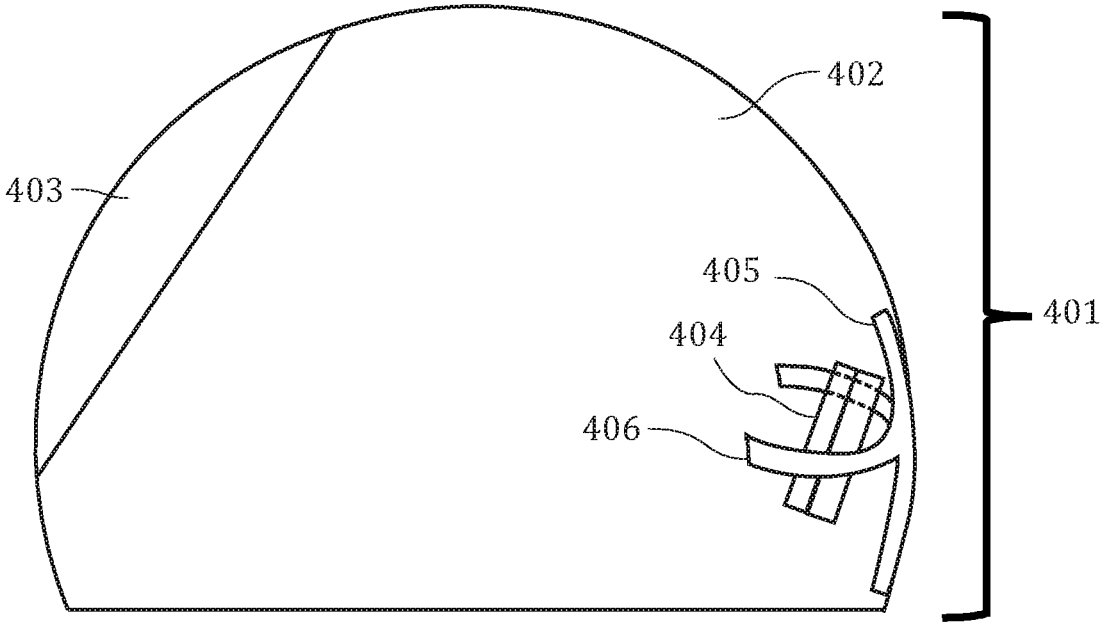
Figure 4B:
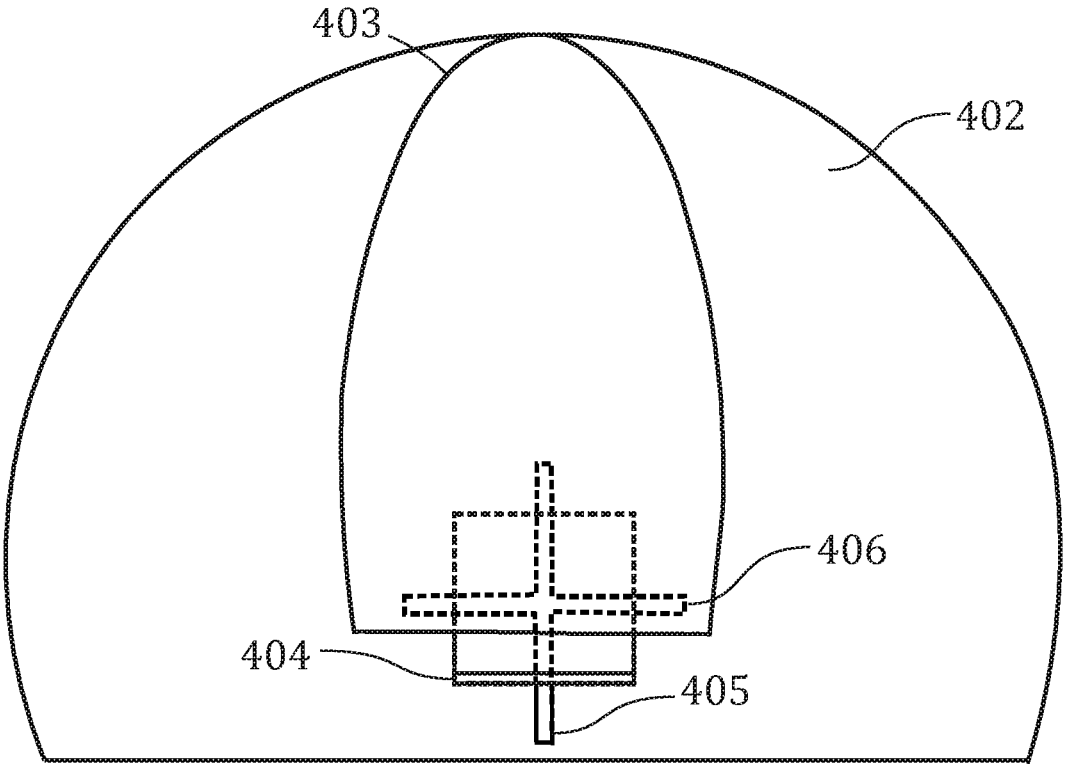

FIGS. 4A and 4B illustrate another exemplary antenna arrangement according to an embodiment. Specifically, FIGS. 4A and 4B show an antenna radome and two feed antennas according to an embodiment from side and front views, respectively. In FIGS. 4A and 4B, the nonmetallic section of the antenna radome is rendered as transparent while dashed lines are used to denote the geometry of the objects obstructed from view by another object. In addition to said illustrated elements, the antenna arrangement may also comprise a flat base, a platform (possibly with a hole), one or more antenna support structures, one or more feed lines and/or corresponding one or more feed ports, similar to as described in relation to FIGS. 3A, 3B, 3C and 3D.

The antenna arrangement of FIGS. 4A and 4B is similar to the one illustrated in FIGS. 3A, 3B, 3C and 3D with a few significant differences. The antenna radome 401 comprises a metallic section 403 and a nonmetallic section 402. However, the metallic section 403 is positioned and/or shaped differently from the one shown in FIGS. 4A, 4B, 4C and 4D. Instead of providing a focal point at the horizontal center of the antenna radome, the metallic section 403 provides in this example a focal point at a position on an inner or outer surface of the antenna radome 401 opposite to the metallic section 403. Accordingly, the two feed antennas are positioned in said surface focal point or at least near said surface focal point.

The antenna arrangement may comprise an array antenna 404 and a crossed dipole antenna (equally called a turnstile antenna) comprising antenna elements 405, 406. The array antenna may be similar to the array antenna 204 of FIGS. 2A, 2B, 2C and 2D and/or the array antenna 301 of FIG. 3. The antenna array may be supported by an antenna support structure (similar to, e.g., element 206 of FIGS. 2A, 2B, 2C and 2D) or it may be fixed or detachably fixed to the antenna radome 401 (or specifically to the nonmetallic section 402 of the antenna radome 401).

The crossed dipole antenna comprises two dipole antenna elements 405, 406 having identical dimensions mounted at right angles to each other. The two dipole antenna elements 405, 406 may be fed in phase quadrature, that is, the two currents applied to the dipoles by two feed lines (not shown in FIGS. 4A and 4B) may be 90° out of phase with each other. The crossed dipole antenna with the aforementioned feeding arrangement may provide close to omnidirectional radiation pattern with dual polarization behavior. One 405 of the antenna elements may be arranged substantially along a vertical direction (i.e., along the height of the antenna radome 401) and the other 406 substantially along a horizontal direction (a direction orthogonal to the vertical direction). The arms of each dipole antenna element 404, 405 may be shaped to conform to the surface of the antenna radome 401 as illustrated in FIG. 4A. The two dipole antenna elements 405, 406 may be specifically half-wave dipole antenna elements. The crossed dipole antenna may be supported by an antenna support structure (similar to, e.g., element 206 of FIGS. 2A, 2B, 2C and 2D) or it may be fixed, detachably fixed or integrated (e.g., printed) to the antenna radome 401 (or specifically to the nonmetallic section 402 of the antenna radome 401). In some embodiments, the crossed dipole antenna may form a second metallic section of the antenna radome 401. Said second metallic section may be implemented, for example, using metallization.

In some embodiments, the dipole antenna elements 404, 405 of the crossed dipole antenna may be fed in-phase (with no phase shift relative to each other) resulting in circular polarization, instead of linear polarization as in the embodiment described in the previous paragraph.

In some embodiments, the crossed dipole antenna may be replaced with another type of feed antenna with similar functionality comprising a third antenna element adapted to transmit and receive horizontally polarized radio waves and a fourth antenna element adapted to transmit and receive vertically polarized radio waves. In other embodiments, the crossed dipole antenna may be replaced by any antenna listed in relation to FIG. 2. For example, the crossed dipole antenna may be replaced by a curved half-wave dipole antenna or other curved resonant antenna integrated into the antenna radome by printing the antenna directly on the nonmetallic section 202 of the antenna radome.

Pointing the antenna to the right direction is of high importance for achieving high signal level and thus good performance for any communications link. This is especially true if an antenna with a narrow beamwidth is used in transmitting and/or receiving ends of the communications link which is typically the case when using millimeter wave frequency. In order to facilitate said pointing of the antenna for the antenna arrangement according to embodiments, the antenna arrangement according to any previous embodiment may comprise one or more pointing mechanisms for performing the pointing (i.e. changing of the orientation of the antenna) in elevation and/or azimuth direction(s).

Figure 5:
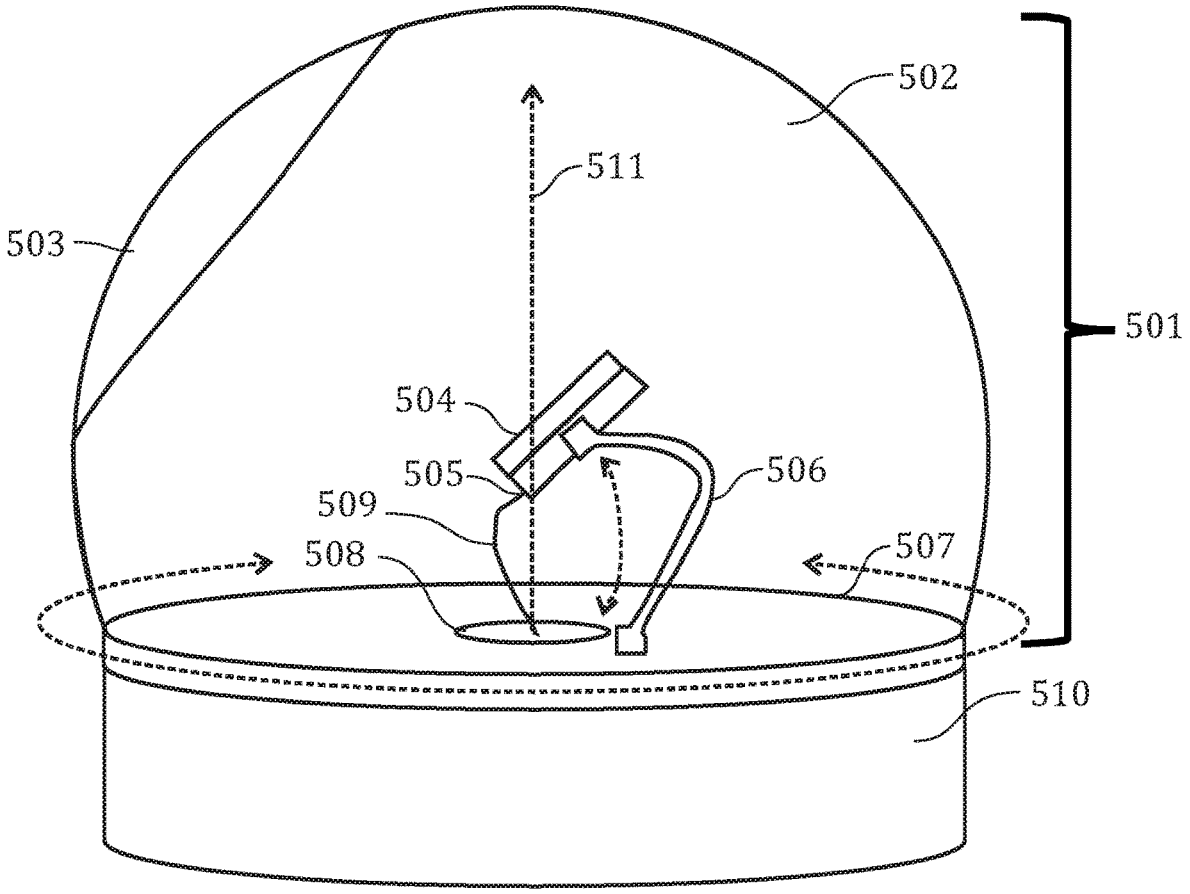

FIG. 5 illustrates an exemplary embodiment for adjusting the orientation of a single feed antenna in azimuth and elevation directions. Similar functionality may be arranged for any of the other feed antennas in an antenna arrangement according to any previous embodiment. The elements 501 to 505 and 508 to 510 may be similar to the elements 201 to 205 and 208 to 210 of FIG. 2. In FIG. 5, the nonmetallic section of the antenna radome is rendered as transparent (similar to FIGS. 4A and 4B).

For achieving adjustability of the pointing direction of the feed antenna 504 in the azimuth direction, the platform 507 may be a rotatable platform which is rotatably fixed to the flat base 510 and nonrotatably fixed to the antenna radome 501 and (possibly via any corresponding support structures 506 if any exist) to the one or more feed antennas 504. Specifically, the rotatable platform 507 may be adapted to provide azimuthal rotation of the one or more feed antennas 504 and the antenna radome 501 around an axis of rotation 511 defined as being orthogonal to the flat base 510 (independent of the flat base 510). Said axis of rotation may be defined to be located in a horizontal center of the antenna radome 501. In the context of the CPE communications scenario, the flat base 510 may comprise one or more circuitry providing CPE functionality which may be connected to wires extending beyond the antenna arrangement and connected, e.g., to further equipment or an electrical socket. The described setup enables free azimuthal rotation of one or more feed antennas unhindered by said wires which could, if the whole base would be rotated, restrict the rotation because of their rigidity or lack of clearance.

For achieving adjustability of the pointing direction of the feed antenna 504 in the elevation direction, the antenna support structure 506 supporting the feed antenna 504 and being fixed to the rotatable platform 507 may be an adjustable antenna support structure. The adjustable antenna support structure may be adapted to provide elevational rotation of the feed antenna 504 in relation to a plane parallel to the flat base 510 (or the platform 507). In some embodiments, some or all of the adjustable antenna support structure(s) 506 may be adjustable not only in terms of an elevation angle but also regards to height of the corresponding feed antenna 504 relative to the rotatable platform 507.

The adjustment of the feed antenna orientation in azimuth and/or elevation direction(s) may be performed manually (i.e., manually rotating the platform 507 and/or manually bending or curving the adjustable antenna support structure 506) or by using mechanical knobs or dials connected to mechanical means for changing the feed antenna orientation in azimuth and/or elevation direction(s).

In some embodiments, the antenna arrangement may comprise circuitry providing a visual and/or audible signal to user in response to the pointing direction of the antenna being correct or close to the correct pointing direction. This functionality may be achieved using a relative signal strength indicator (RSSI) comprised in a radio signal received by any of the one or more feed antennas. Baseband circuity may be configured to derive the RSSI based on the received radio signal and to communicate it further to a controlling microprocessor. The controlling microprocessor may, in turn, be configured to switch on a number of LEDs (Light Emitting Diodes) depending on the received signal strength. Alternatively or simultaneously, a buzzer may be activated with an intensity that grows with the signal strength. The pointing process may be initiated and terminated by the user pressing a button.

In some embodiments, only one of the two functionalities for adjusting feed antenna orientation in azimuth and elevation directions may be implemented.

As used in this application, the term "circuitry" may refer to one or more or all of the following:

(a) hardware-only circuit implementations (such as implementations in only analog and/or digital circuitry) and (b) combinations of hardware circuits and software, such as (as applicable):

(i) a combination of analog and/or digital hardware circuit (s) with software/firmware and (ii) any portions of hardware processor(s) with software (including digital signal processor(s)), software, and memory(ies) that work together to cause an apparatus, such as a mobile phone or server, to perform various functions) and (c) hardware circuit(s) and or processor(s), such as a microprocessor(s) or a portion of a microprocessor(s), that requires software (e.g., firmware) for operation, but the software may not be present when it is not needed for operation.

This definition of circuitry applies to all uses of this term in this application, including in any claims. As a further example, as used in this application, the term circuitry also covers an implementation of merely a hardware circuit or processor (or multiple processors) or portion of a hardware circuit or processor and its (or their) accompanying software and/or firmware. The term circuitry also covers, for example and if applicable to the particular claim element, a baseband integrated circuit or processor integrated circuit for a mobile device or a similar integrated circuit in server, a cellular network device, or other computing or network device.

Even though the invention has been described above with reference to an example according to the accompanying drawings, it is clear that the invention is not restricted thereto but can be modified in several ways within the scope of the appended claims. Therefore, all words and expressions should be interpreted broadly and they are intended to illustrate, not to restrict, the embodiment. It will be obvious to a person skilled in the art that, as technology advances, the inventive concept can be implemented in various ways. Further, it is clear to a person skilled in the art that the described embodiments may, but are not required to, be combined with other embodiments in various ways.

The invention claimed is:

1. An antenna arrangement comprising:

two or more feed antennas adapted to transmit and receive radio signals, wherein the two or more feed antennas comprise at least a first feed antenna adapted to operate in a first frequency band and a second feed antenna adapted to operate in a second frequency band, the first frequency band and the second frequency band being discontiguous with each other;

a rotatable platform, said two or more feed antennas being fixed to the rotatable platform; and an antenna radome arranged around and, with the rotatable platform, enclosing the two or more feed antennas, the antenna radome being attached to and rotatable with the rotatable platform, wherein the antenna radome comprises a metallic section implementing an antenna reflector for the two or more feed antennas and a nonmetallic section penetrable by radio waves, wherein the metallic section was implemented by fixing a metallic part to the antenna radome or by metallizing at least one surface area of the antenna radome, the at least one surface area being on one or more of an inner surface and an outer surface of the antenna radome, and wherein the metallic section has a parabolic shape forming a parabolic antenna reflector, the two or more feed antennas being arranged substantially at a focal point of the antenna reflector.

2. The antenna arrangement according to claim 1, wherein the metallic section is adapted to provide the focal point in one of the following: a first position within the antenna radome and in a center of the antenna radome on a horizontal plane and a second position on an inner or outer surface of the antenna radome opposite to the metallic section, the horizontal plane being defined as a plane orthogonal to a direction of height of the antenna radome.

3. The antenna arrangement according to claim 2, wherein the metallic section covers less than half of a surface area of the antenna radome.

4. The antenna arrangement according to claim 1, wherein the two or more feed antennas comprise one or more feed antennas of the following types: an array antenna, a phased array antenna, a dipole antenna, a curved dipole antenna, a monopole antenna, a microstrip antenna, a curved microstrip antenna, a horn antenna, a horn lens antenna, a slotted antenna and a slotted array antenna.

5. The antenna arrangement according to claim 1, wherein the first frequency band comprises at least one frequency above 20 GHz and below 100 GHz and the second frequency band comprises at least one frequency above 1 GHz and below 6 GHz.

6. The antenna arrangement according to claim 1, wherein the first frequency band comprises at least one of 28 GHz, 38 GHz, 39 GHz and 60 GHz and/or the second frequency band comprises at least one of 3.6 GHz and 5 GHz.

7. The antenna arrangement according to claim 1, wherein the first feed antenna is a first array or phased array antenna comprising two or more first planar microstrip antenna elements arranged in one or two dimensions and/or the second feed antenna is one of a second array or phased array antenna comprising two or more second planar microstrip antenna elements arranged in one or two dimensions and a dipole antenna.

8. The antenna arrangement according to claim 1, wherein the second feed antenna is an array antenna comprising a third antenna element adapted to transmit and receive horizontally polarized radio waves and a fourth antenna element adapted to transmit and receive vertically polarized radio waves.

9. An antenna arrangement comprising:

two or more feed antennas adapted to transmit and receive radio signals, wherein the two or more feed antennas comprise at least a first feed antenna adapted to operate in a first frequency band and a second feed antenna adapted to operate in a second frequency band, the first frequency band and the second frequency band being discontiguous with each other;

a rotatable platform, said two or more feed antennas being fixed to the rotatable platform; and an antenna radome arranged around and, with the rotatable platform, enclosing the two or more feed antennas, the antenna radome being attached to and rotatable with the rotatable platform, wherein the antenna radome comprises a metallic section implementing an antenna reflector for the two or more feed antennas and a nonmetallic section penetrable by radio waves, and wherein the second feed antenna is a curved resonant antenna printed on the nonmetallic section of the antenna radome.

10. The antenna arrangement according to claim 1, further comprising:

a flat base, the flat base supporting the two or more feed antennas, the rotatable platform, and the antenna radome.

11. The antenna arrangement according to claim 10, wherein the antenna radome has the shape of a spherical thin hollow dome arranged around the two or more feed antennas, a rim of the spherical dome being arranged against the flat base.

12. The antenna arrangement according to claim 11, wherein the rotatable platform is rotatably fixed to the flat base, wherein the rotatable platform is adapted to provide azimuthal rotation of the two or more feed antennas and the antenna radome around an axis of rotation, the axis of rotation being orthogonal to the flat base.

13. An antenna arrangement comprising:

two or more feed antennas adapted to transmit and receive radio signals, wherein the two or more feed antennas comprise at least a first feed antenna adapted to operate in a first frequency band and a second feed antenna adapted to operate in a second frequency band, the first frequency band and the second frequency band being discontiguous with each other;

a rotatable platform, said two or more feed antennas being fixed to the rotatable platform; and an antenna radome arranged around and, with the rotatable platform, enclosing the two or more feed antennas, the antenna radome being attached to and rotatable with the rotatable platform, wherein the antenna radome comprises a metallic section implementing an antenna reflector for the two or more feed antennas and a nonmetallic section penetrable by radio waves;

a flat base, the flat base supporting the two or more feed antennas, the rotatable platform, and the antenna radome; and at least one adjustable antenna support structure supporting at least one of the two or more feed antennas, wherein each adjustable antenna support structure is adapted to provide elevational rotation of at least one of the two or more feed antennas in relation to a plane parallel to the flat base.

* * * * *